US008763408B2

(12) United States Patent
Ma et al.

(10) Patent No.: US 8,763,408 B2
(45) Date of Patent: Jul. 1, 2014

(54) HYBRID THERMOELECTRIC-EJECTOR COOLING SYSTEM

(75) Inventors: Hongbin Ma, Columbia, MO (US); Peng Cheng, Columbia, MO (US); Joseph A. Boswell, San Francisco, CA (US)

(73) Assignee: The Curators of the University of Missouri, Columbia, MO (US)

( * ) Notice: Subject to any disclaimer, the term of this patent is extended or adjusted under 35 U.S.C. 154(b) by 707 days.

(21) Appl. No.: 12/896,597

(22) Filed: Oct. 1, 2010

(65) Prior Publication Data

US 2011/0079022 A1 Apr. 7, 2011

Related U.S. Application Data

(60) Provisional application No. 61/247,824, filed on Oct. 1, 2009.

(51) Int. Cl.
*F25B 21/02* (2006.01)
*F28D 15/00* (2006.01)

(52) U.S. Cl.
USPC ..... 62/3.2; 62/3.7; 165/104.26

(58) Field of Classification Search
USPC ..... 62/3.2, 116, 500; 165/104.21, 104.26
See application file for complete search history.

(56) References Cited

U.S. PATENT DOCUMENTS

| | | | |
|---|---|---|---|
| 1,777,239 | A | 9/1930 | Weir |
| 1,870,265 | A | 8/1932 | Seligmann |
| 1,952,214 | A | 3/1934 | Nelson |
| 2,605,618 | A | 8/1952 | Burggrabe |
| 2,931,190 | A | 4/1960 | Dubitzky |
| 3,199,310 | A | 8/1965 | Schlichtig |
| 3,440,832 | A | 4/1969 | Aronson |

(Continued)

FOREIGN PATENT DOCUMENTS

WO 2009070728 A1 6/2009

OTHER PUBLICATIONS

Borgmeyer, B. et al., Experimental Investigation of Oscillating Motions in a Flat Plate Pulsating Heat Pipe, Journal of Thermophysics and Heat Transfer, vol. 21, No. 2, Apr.-Jun. 2007, pp. 405-409.

(Continued)

*Primary Examiner* — Cassey D Bauer
*Assistant Examiner* — Steve Tanenbaum
(74) *Attorney, Agent, or Firm* — Senniger Powers LLP

(57) ABSTRACT

A hybrid thermoelectric-ejector active cooling system having an increased Coefficient of Performance (COP) when compared to typical thermoelectric cooling modules. A thermoelectric cooling module is integrated with an ejector cooling device so that heat from the thermoelectric cooling module is rejected to a high temperature evaporator of the ejector cooling device. This provides for a total COP greater than the sum of the COPs of the thermoelectric cooling module and ejector cooling device individually. For example, given 1 unit input power into the thermoelectric cooling module, the heat received by the cold side of the thermoelectric cooling module would be $COP_{TEC}\times 1$; and the energy rejected by the hot side of the thermoelectric cooling module and to drive the ejector cooling device would be $COP_{TEC}+1$. Thus, the cooling received by the low temperature evaporator of the ejector cooling device is $COP_{Ej}\times(COP_{TEC}+1)$; and therefore total $COP_{TE\text{-}Ej\text{-}AC}$ is $COP_{Ej}+COP_{TEC}+COP_{Ej}\times COP_{TEC}$. In addition, the hybrid thermoelectric ejector active cooling system will be able to operate at higher temperature differentials than standalone thermoelectric cooling devices.

9 Claims, 11 Drawing Sheets

(56) References Cited

U.S. PATENT DOCUMENTS

| | | | | |
|---|---|---|---|---|
| 3,741,289 | A * | 6/1973 | Moore | 165/272 |
| 4,173,994 | A | 11/1979 | Hiser | |
| 4,290,273 | A | 9/1981 | Meckler | |
| 4,329,851 | A | 5/1982 | Bourne | |
| 4,336,837 | A * | 6/1982 | Koenig | 165/104.22 |
| 4,395,648 | A | 7/1983 | Marks | |
| 4,761,970 | A | 8/1988 | MacCracken | |
| 4,795,618 | A | 1/1989 | Laumen | |
| 4,921,041 | A | 5/1990 | Akachi | |
| 5,240,384 | A | 8/1993 | Tuzson | |
| 5,322,222 | A | 6/1994 | Lott | |
| 5,444,987 | A | 8/1995 | Alsenz | |
| 5,463,880 | A | 11/1995 | Nishino et al. | |
| 5,586,442 | A | 12/1996 | Nicodemus | |
| 5,673,566 | A | 10/1997 | Eames et al. | |
| 5,737,840 | A | 4/1998 | Akachi | |
| 5,921,315 | A | 7/1999 | Dinh | |
| 6,138,456 | A | 10/2000 | Garris | |
| 6,966,199 | B2 | 11/2005 | Takeuchi | |
| 7,140,197 | B2 * | 11/2006 | Chordia et al. | 62/401 |
| 7,306,028 | B2 * | 12/2007 | Zuo et al. | 165/104.26 |
| 2002/0062648 | A1 * | 5/2002 | Ghoshal | 62/3.7 |
| 2004/0211207 | A1 | 10/2004 | Forkosh et al. | |
| 2005/0127322 | A1 | 6/2005 | Costello et al. | |
| 2006/0230776 | A1 | 10/2006 | Inoue et al. | |
| 2006/0266072 | A1 | 11/2006 | Takeuchi et al. | |
| 2007/0034354 | A1 | 2/2007 | Tung et al. | |
| 2007/0056729 | A1 | 3/2007 | Pankratz et al. | |
| 2009/0101308 | A1 | 4/2009 | Hardesty | |
| 2009/0223650 | A1 * | 9/2009 | Williams et al. | 165/104.17 |
| 2011/0259039 | A1 | 10/2011 | Ma et al. | |

OTHER PUBLICATIONS

Cheng, Peng et al., An Investigation of Flat-Plate Oscillating Heat Pipes, ASME Journal of Electronic Packaging, vol. 132, No. 4 041009, Dec. 2010, 20 pgs.

Khandekar, S. et al., Thermofluid Dynamic Study of Flat-Plate Closed-Loop Pulsating Heat Pipes, Microscale Thermophysical Engineering, 6:303-317 (2002), 15 pgs.

Thompson, S. M., et al., Experimental Investigation of Miniature Three-Dimensional Flat-Plate Oscillating Heat Pipe, Journal of Heat Transfer, vol. 131, Apr. 2009, 10 pages.

Boswell, Joe, Project entitled Solar Thermal HVAC System Driven by a High-Efficiency Heat-Pipe Jet Engine, ThermAvant Technologies LLC, 19 pages, 2007.

3M Novec 7000 engineered Fluid, Sep. 2009, pates 1-6.

Thermodynamics—Property Tables and Charts, Jul. 2009, pp. 1-6.

* cited by examiner

HYBRID THERMOELECTRIC-EJECTOR COOLING SYSTEM

STATEMENT OF RELATED CASES

This is a non-provisional application of U.S. Provisional Application Ser. No. 61/247,824, filed Oct. 1, 2009, the disclosure of which is incorporated herein by reference.

FIELD OF THE INVENTION

The present invention relates generally to cooling systems and more particularly to a hybrid integrated cooling system including an active thermoelectric cooling device and an ejector cooling device.

BACKGROUND OF THE INVENTION

Thermoelectric cooling systems are useful in many applications because they can be relatively small (e.g., a plate) and have no moving parts. Thermoelectric coolers use the Peltier effect to create cooling on one side of a plate or the like. However, the efficiency of thermoelectric cooling systems is inadequate for many applications, particularly where it is required to have a large temperature differential across the plate. In that event heat transfer from the hot side of the plate back to the cold side reduces effectiveness of the cold side in absorbing heat from the object or space to be cooled. Ejector cooling devices enjoy some of the same advantages, including that they have or can have no moving parts and can be constructed on a small scale. However, ejector cooling devices also suffer from efficiency problems in certain applications.

SUMMARY OF THE INVENTION

In one aspect of the present invention, an active cooling system for transferring heat from a heat source to an external heat sink generally comprises an ejector cooling system having a high temperature evaporator and a low temperature evaporator, and a thermoelectric cooling device. The thermoelectric cooling device has a hot side in thermal communication with the high temperature evaporator for supplying heat used to vaporize a primary fluid and a cold side in thermal communication with the low temperature evaporator for removing heat from the low temperature evaporator.

In another aspect of the present invention, an active cooling system for transferring heat from a heat source to an external heat sink generally comprises a low temperature evaporator for removing heat from the heat source, a pump for drawing refrigerating fluid from the low temperature evaporator and increasing the pressure of the fluid, and a condenser downstream of the pump for use in condensing the refrigerating fluid. A wicking structure in the condenser extends generally to the low temperature evaporator for capturing at least a portion of the condensed refrigerating fluid in the condenser and moving the condensed refrigerating fluid by capillary action back to the low temperature evaporator.

In still another aspect of the present invention, an active cooling system for transferring heat from a heat source to an external heat sink generally comprises a low temperature evaporator adapted to receive a secondary fluid for evaporation of the secondary fluid to absorb heat from the heat source. A thermoelectric cooling module uses electrical input power to generate refrigeration or cooling. An ejector cooling module integrated with the thermoelectric module includes a high temperature evaporator adapted to contain a primary fluid.

The thermoelectric cooling module is disposed for rejecting heat into the high temperature evaporator of the ejector cooling module. A converging-diverging nozzle connected to the high temperature evaporator accelerates primary fluid to a high velocity and produces low static pressure. A mixing chamber for receiving high velocity primary fluid from the converging-diverging nozzle aspirates secondary fluid vapor from the low temperature evaporator. A diffuser chamber receives mixed primary and secondary fluid vapor from the mixing chamber, and is adapted to transition the flow of mixed primary and secondary fluids from high speed to stagnation so that the mixed flow can gain static pressure. A condenser is adapted to receive the primary and secondary fluid vapor from the ejector's diffuser chamber and reject heat to a heat sink outside the cooling system so that the vaporous primary and secondary fluids lower their temperature to their saturation points and liquefy. A wick structure connecting the condenser to the high temperature evaporator so that the liquids in the condenser can travel from the condenser to the high temperature evaporator by way of capillary force. A micro/nano-structured surface within the high temperature evaporator distributes the liquid within the high temperature evaporator and enhances thin film evaporation heat transfer. A duct between the high temperature evaporator and the low temperature evaporator is constructed to pass fluid from the high temperature evaporator to the low temperature evaporator at a certain flow rate of liquid to provide sufficient flow to the low temperature evaporator but not so much flow that the high temperature evaporator lacks sufficient fluid for heat transfer from the thermoelectric cooling module or for powering the ejector. A micro/nano-structured surface within the low temperature evaporator distributes the liquid within the low temperature evaporator and enhances thin film evaporation heat transfer. Insulating material is located between at least one of the condenser and high temperature evaporator; and the ejector's diffuser and high temperature evaporator

BRIEF DESCRIPTION OF THE DRAWINGS

Corresponding reference characters indicate corresponding parts throughout the several views of the drawings.

DESCRIPTION

Figure 1:
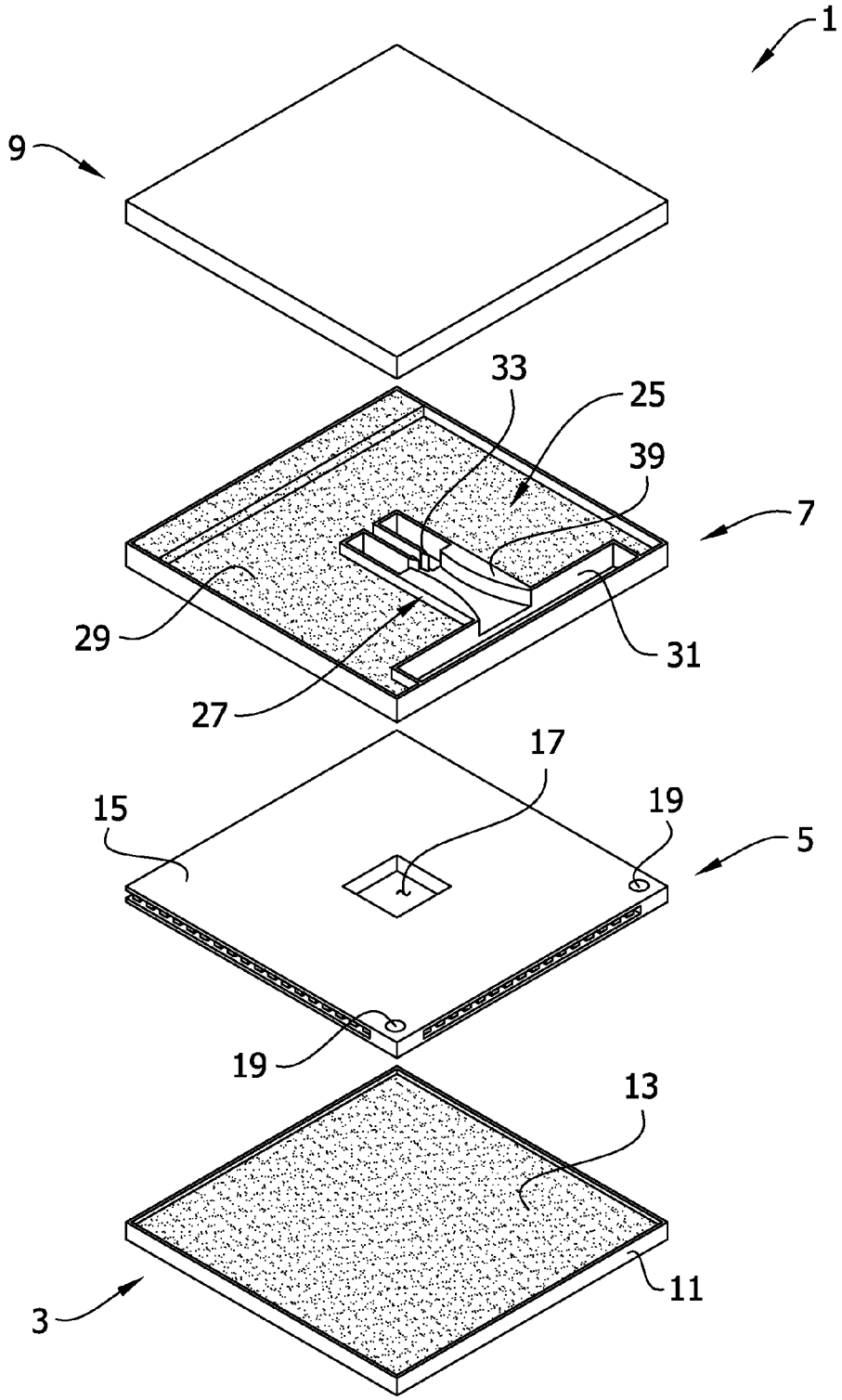
FIG. 1 is an exploded perspective of a hybrid integrated thermal electric and ejector cooling system constructed according to the principals of the present invention.
Figure 2:
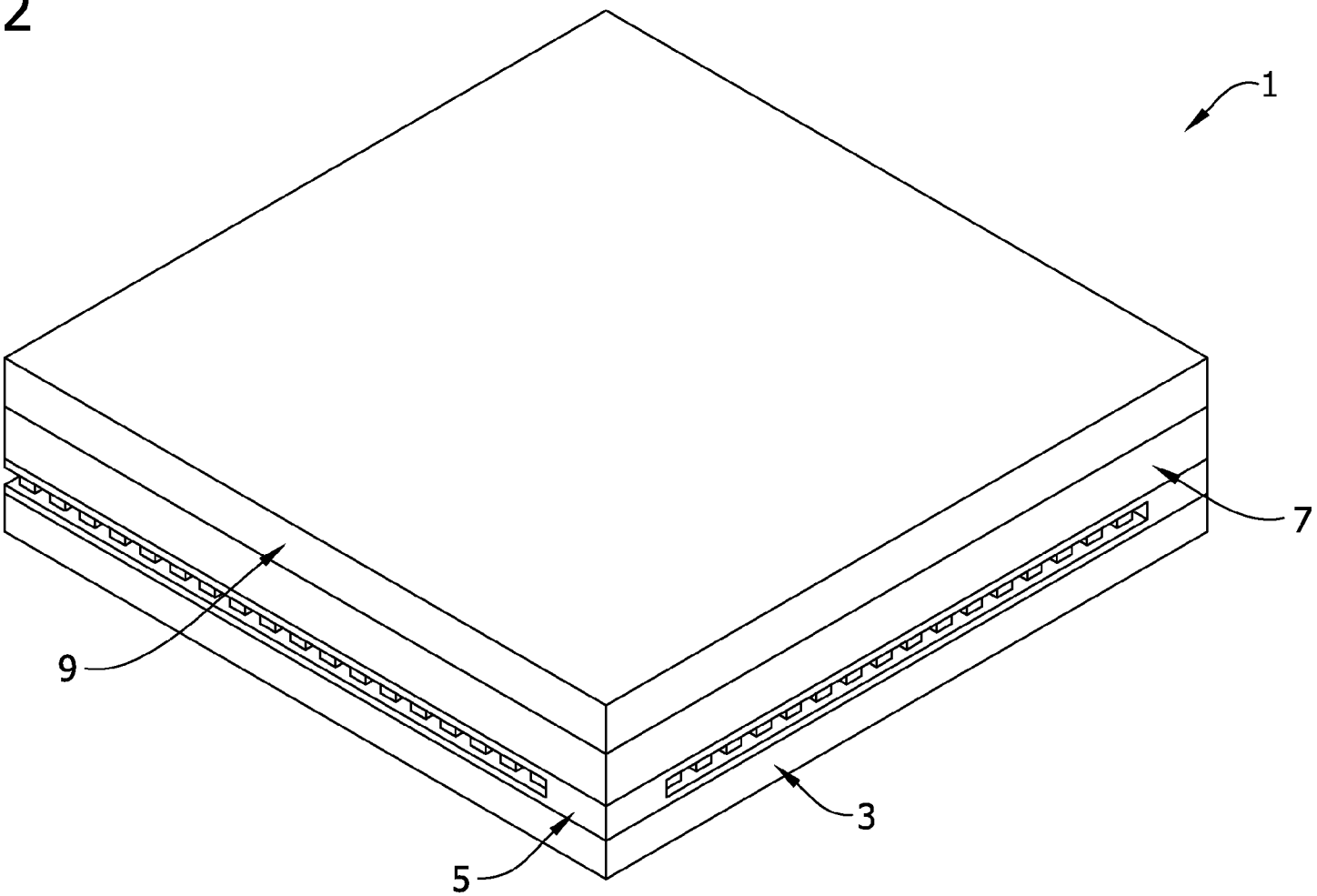
FIG. 2 is a perspective of the assembled hybrid integrated cooling system.

Referring now to the drawings, and in particular to FIGS. 1 and 2, an active hybrid integrated cooling system 1 constructed according to the principles of the present invention comprises a low temperature evaporator module 3, a thermoelectric cooler module 5, an ejector and high temperature evaporator module 7 and a condenser module 9 (all reference numbers designated their subjects generally). Although the components making up the hybrid integrated cooling system 1 are shown as separable modules, the hybrid integrated cooling system may be formed in other ways not employing separable modules. The hybrid integrated cooling system 1 may use a primary fluid and a secondary fluid for operation. These fluids may be the same or different fluids. Water is a suitable primary and/or secondary working fluid. As shown in FIG. 2, the assembled hybrid integrated cooling system 1 is thin and flat. The components of the hybrid integrated cooling system 1 can be manufactured using micromachining so that the overall size of the hybrid integrated cooling system can be very small. For example, the hybrid integrated cooling system 1 shown in FIG. 2 may have dimensions such as 5 mm in thickness, 20 mm in width and 20 mm in depth. A hybrid integrated cooling system of this configuration might be useful in an application for cooling electronics (not shown). It will be understood that the size, method of manufacture or particular application can be other than described within the scope of the present invention.

The low temperature evaporator module 3 includes a housing 11 having a bottom and sides. Referring now also to FIG. 4, the housing 11 contains wicking structure 13 and thin film evaporation surface on top of the wicking structure. The wicking structure 13 is particularly constructed for drawing condensed refrigerating liquid into the low temperature evaporator module 3 and distributing the fluid across the evaporator by capillary action. Small pores in the wicking structure 13 are sized to create a capillary force to draw the secondary fluid into the pores. Generally speaking the capillary force is dependent on the surface tension of the pore opening and to the contact angle of the secondary fluid. Preferably, the pore sizes are controlled to optimize capillary action for the selected secondary fluid. In addition material selection for the wicking structure 13 may take into consideration the wetting capability of the secondary fluid to the particular material, which also affects the capillary action The thin film evaporating surface on the wicking structure 13 includes microwicking structures that draw the secondary fluid up in a thin film that maximizes evaporation efficiency. In the presence of a thin film of liquid, most of the heat will be transferred through a very small region. When evaporation occurs only at the liquid-vapor interface in the thin film region, where the resistance to the vapor flow is negligible, evaporating heat transfer can be significantly enhanced, resulting in a much higher evaporating heat transfer coefficient than nucleate boiling heat transfer common in conventional refrigeration. The housing 11, or at least the bottom of the housing, receives heat from the source to be cooled by the hybrid integrated cooling system 1 into the low temperature evaporator module 3. The heat inflow $Q_{in}$ is illustrated by arrows below the hybrid integrated cooling system 1 shown in FIG. 3. This heat is absorbed by evaporating secondary fluid in the low temperature evaporator.

Figure 5:
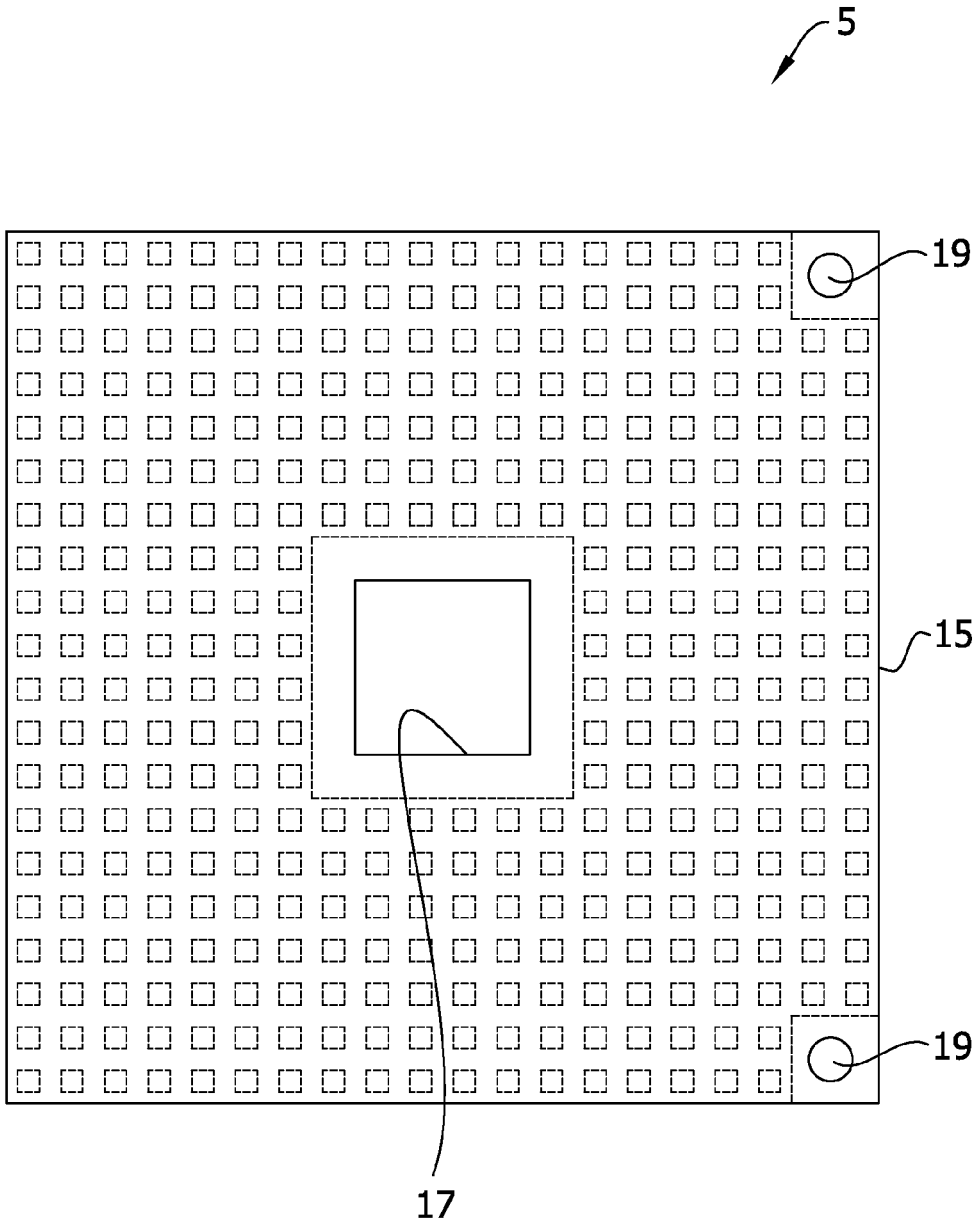
FIG. 5 is a top plan view of a thermoelectric cooler module of the hybrid integrated cooling system.
Figure 6:
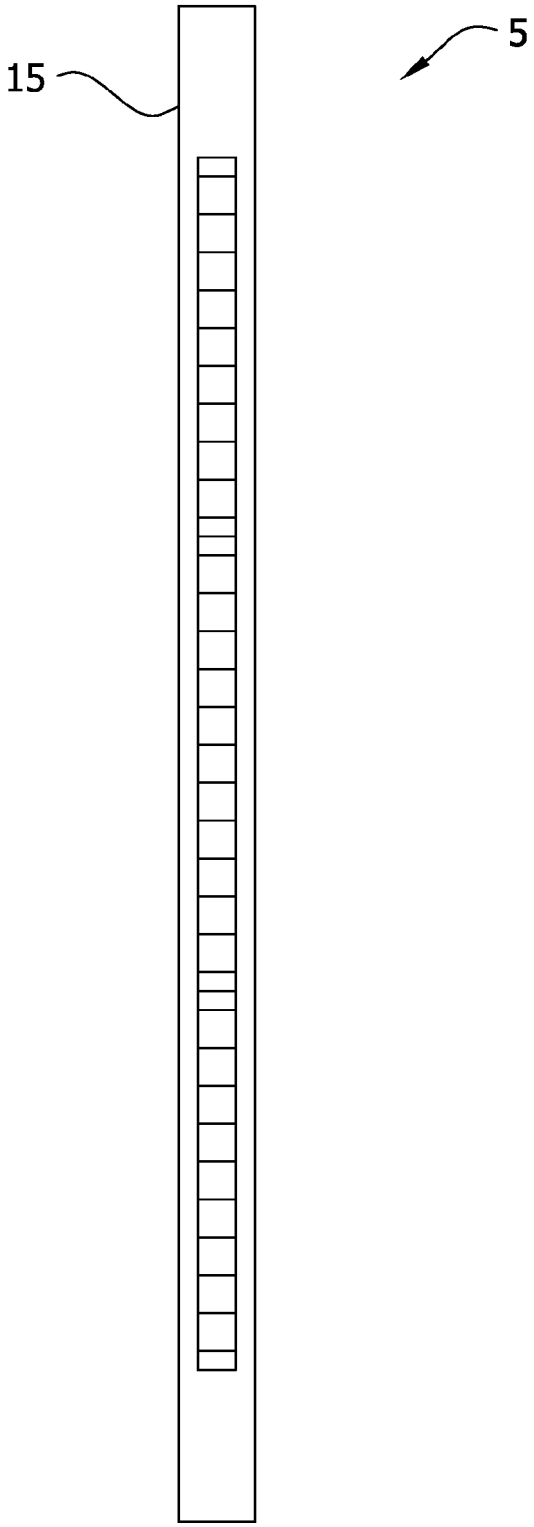
FIG. 6 is a right side elevation of the thermoelectric cooler module.
Figure 7:
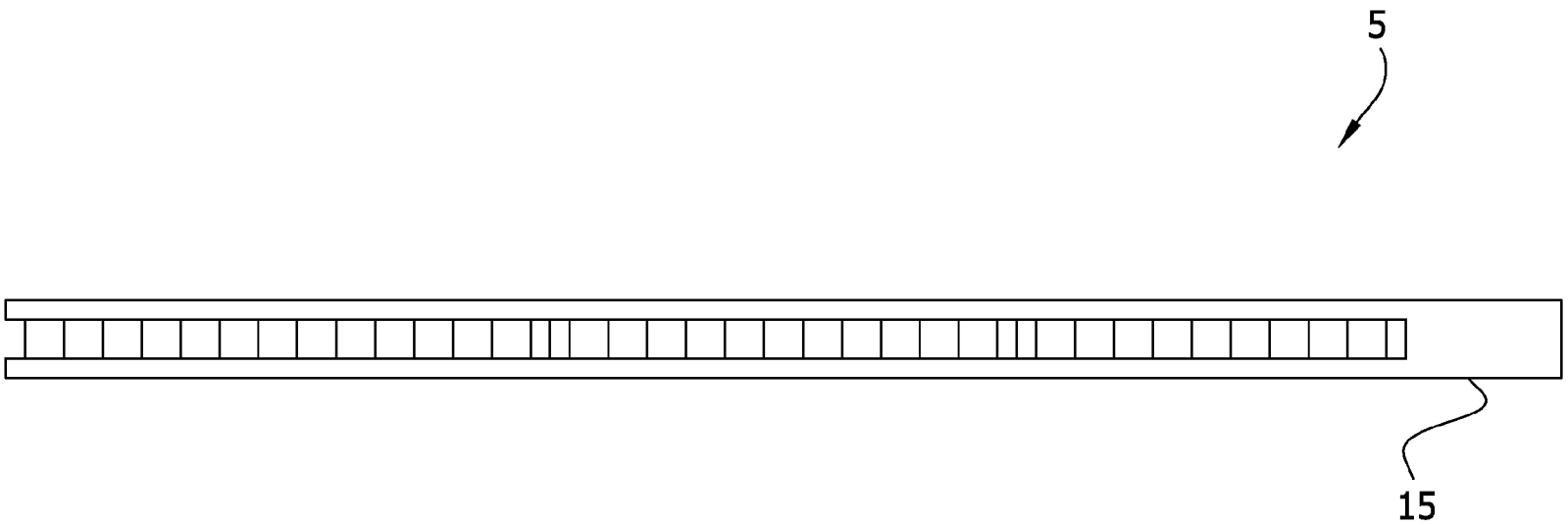
FIG. 7 is bottom side elevation of the thermoelectric cooler module.

The thermoelectric cooler module 5 is located immediately above the low temperature evaporator module 3. The thermoelectric cooler module 5 comprises a plate 15 to which an electric potential can be applied to produce a cold side facing the low temperature evaporator module 3 and a hot side facing away from the low temperature evaporator module. The plate 15 may use the Peltier effect conventional for thermoelectric cooling. The plate 15 has a central opening 17 for passing evaporated secondary fluid out of the low temperature evaporator module 3 and two return openings 19 for passing condensed secondary fluid back into the low temperature evaporator module (see FIGS. 5 and 6). A column 21 of wicking material (see FIG. 3) extends through each return opening 19 to assist in movement of the secondary fluid back into the low temperature evaporator module 3 while blocking the flow of vapor, as will be described hereinafter. It will be understood that the number and arrangement of the openings 17, 19 may be other than described within the scope of the present invention.

Figure 8:
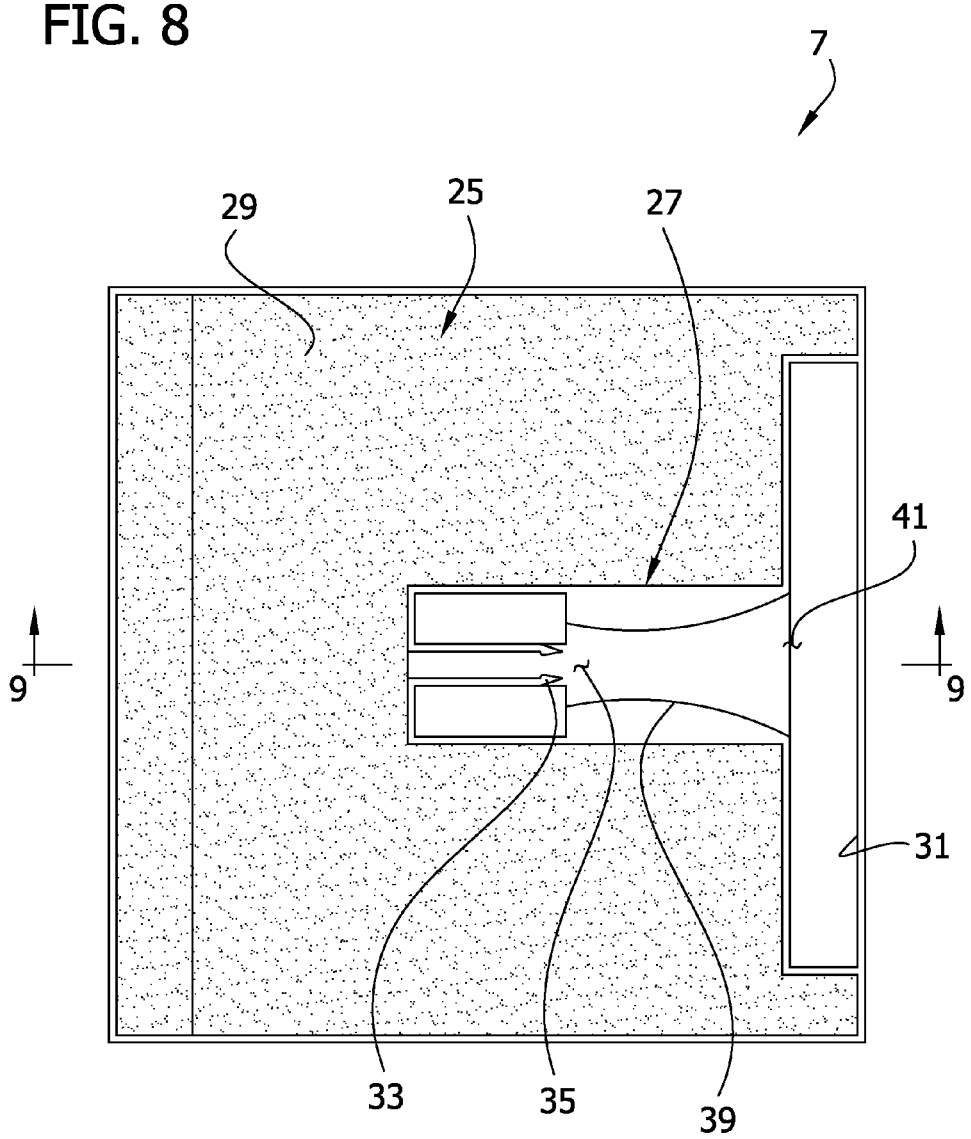
FIG. 8 is a plan view of a ejector and high temperature evaporator module of the hybrid integrated cooling system.
Figure 9:
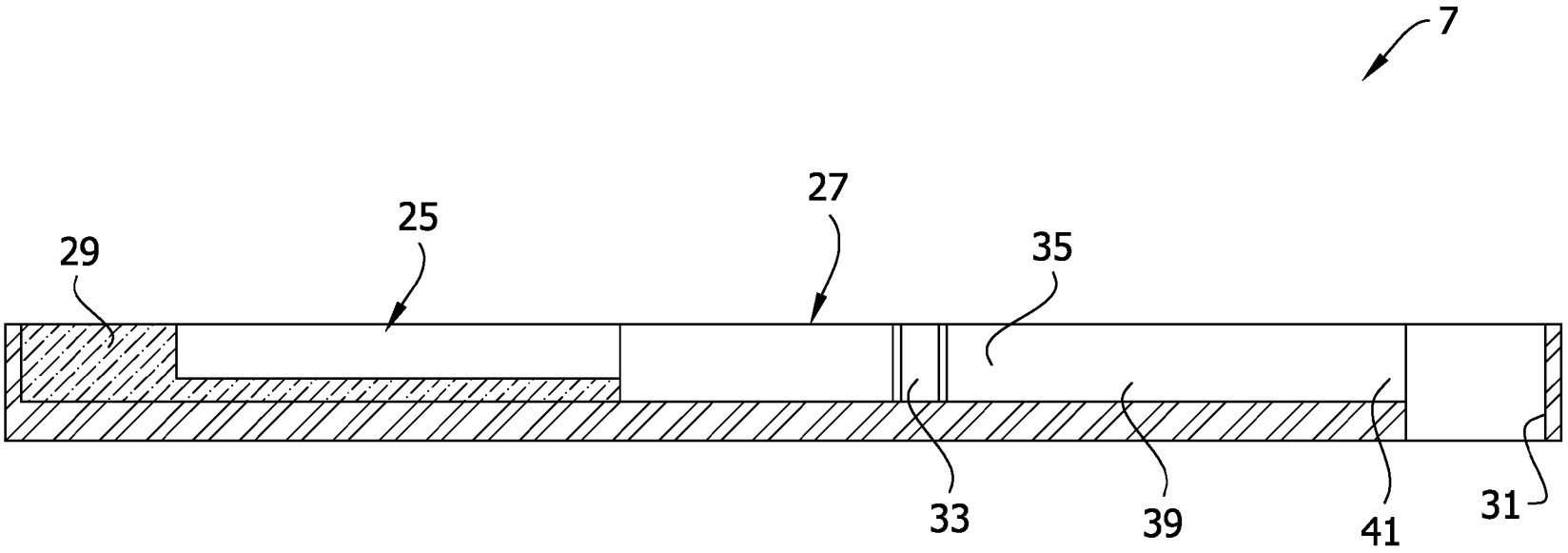
FIG. 9 is a section of the ejector and high temperature evaporator module taken in the plane including line 9-9 of FIG. 8.
Figure 10:
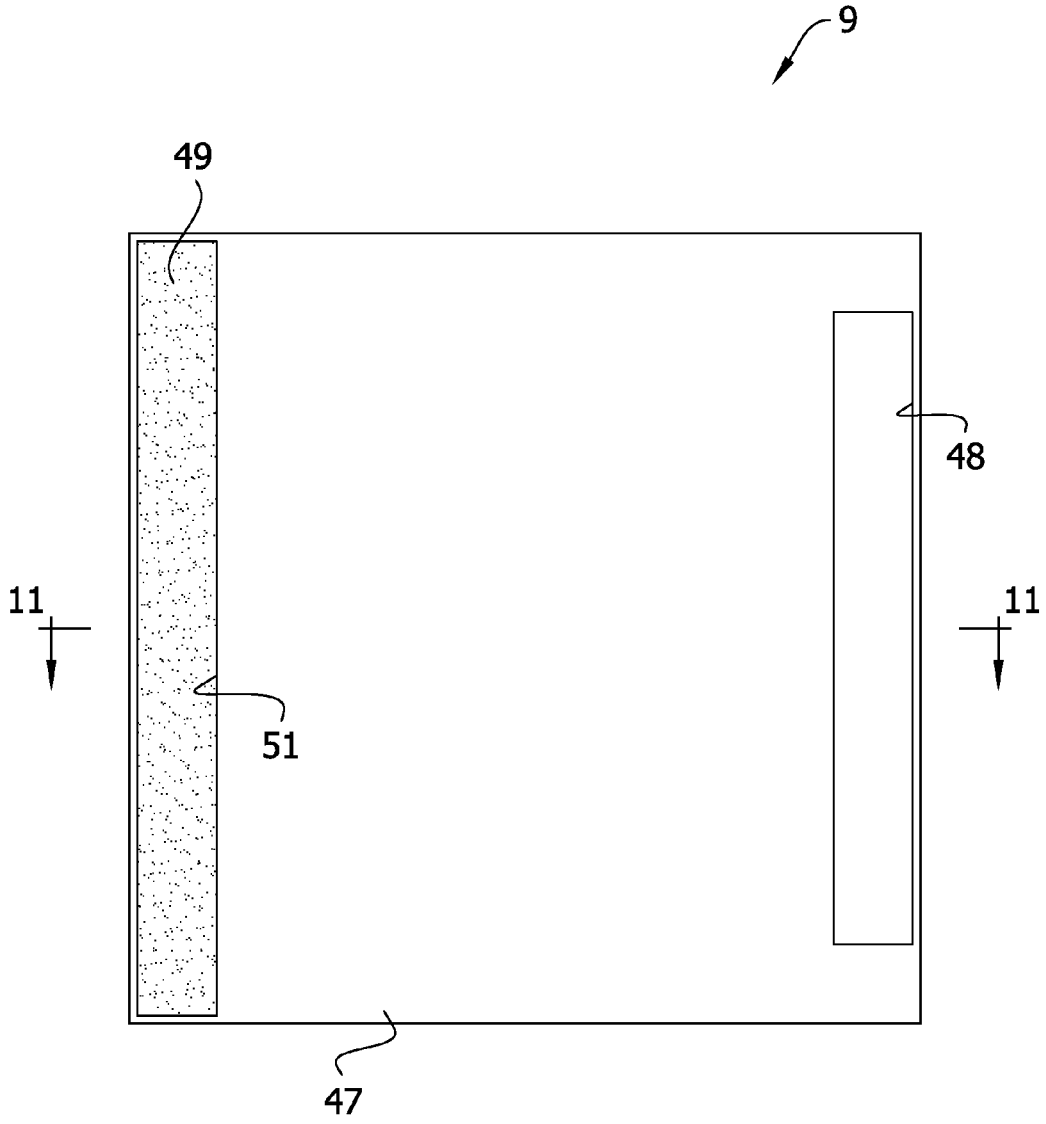
FIG. 10 is a bottom plan view of a condenser module of the hybrid integrated cooling system.

The hot side of the thermoelectric cooler module plate 15 faces into the ejector and high temperature evaporator module 7, which is located just above the thermoelectric cooler module 5. The temperature of the hot side of the plate 15 is greater than the temperature of the source of heat $Q_{in}$ to be cooled by the hybrid integrated cooling system 1 of the present invention. As will be described, this heat is used, and hence removed from the hot side of the thermoelectric plate 15, to drive an ejector cooler. More particularly, the heat generated from the hot side of the thermoelectric plate 15 is used to vaporize the primary fluid in the ejector and high temperature evaporator module 7. Referring to FIGS. 1, 8 and 9, the ejector and high temperature evaporator module 7 comprises a high temperature evaporator and an ejector, generally indicated at 25 and 27, respectively. As may be seen in FIG. 8, wicking structure 29 in the high temperature evaporator 25 covers a substantial portion of the module 7 except where the ejector 27 is located and an opening 31 for passage of vapor from the ejector to the condenser module 9. The wicking structure 29 is taller at the left end of the module (see, FIG. 9) so that it extends up into contact with the condenser module 9 to facilitate liquid flow, as will be described in more detail. The wicking structure 29 has a thin film evaporation surface that promotes heat transfer from the hot side of the plate 15 to the primary fluid through thin film evaporation, as previously described for the low temperature evaporation module 3. Evaporation of the primary fluid in the substantially enclosed space of the high temperature evaporator 25 increases the pressure in the high temperature evaporator. This provides the energy to drive operation of the ejector refrigeration cycle and further removes the heat (a portion of $Q_{in}$) transferred to the cold side of the plate 15. Further removing heat from the cold side of the plate 15 improves efficiency of the plate. The ejector 27 of the illustrated embodiment is similar in operating principles to that disclosed in International Application No. PCT/US2008/084968, filed Nov. 26, 2008, the disclosure of which is incorporated herein by reference. This International application also describes wicking structure and thin film evaporation structure of the type that can be used in the current application.

The ejector 27 is fluidically isolated from the high temperature evaporator 25 except through a primary nozzle 33, which opens into a mixing chamber 35 of the ejector. Although a single primary nozzle 33 is illustrated, multiple nozzles may be used. In the illustrated embodiment, the primary nozzle 33 is a micronozzle, but other sizes may be used within the scope of the present invention to achieve even greater efficiency. The mixing chamber 35 communicates with the low temperature evaporator module 3 through an opening 37 in the ejector 27 and high temperature evaporator module 7 that is aligned with the central opening 17 in the thermoelectric plate 15. A throat member 39 communicates with both the primary nozzle 33 and the mixing chamber 35. The throat member 39 opens opposite the mixing chamber 35 into a subsonic diffuser chamber 41 that leads to the vapor passage opening 31 to the condenser module 9. The ejector 27 is thermally insulated from the hot side of the thermoelectric plate 15 by an insulating panel 43 disposed between the hot side of the thermoelectric plate and the ejector 27 (see, FIG. 3). In operation, high pressure primary fluid vapor enters the primary nozzle 33 from the high temperature evaporator 25. The primary fluid expands and accelerates through the converging-diverging primary nozzle 33. As the primary fluid vapor exits the primary nozzle 33 into the mixing chamber 35, the primary fluid vapor expands at supersonic speed in the mixing chamber, creating a very low pressure in the mixing chamber. The low pressure in the mixing chamber 35 is below the vapor pressure of the secondary fluid in the low temperature evaporator module 3, and draws secondary fluid vapor into the mixing chamber through the openings 17, 37. This drives evaporation of the secondary fluid in the low temperature evaporator module 3 to produce, along with the absorption of heat by the cold side of the thermoelectric plate 15, useful refrigeration. At some location within the mixing chamber 35, the secondary fluid reaches a mixing velocity that is the lower of the secondary fluid's sonic speed and the velocity of the primary fluid vapor in the mixing chamber. The primary and secondary fluids are preferably completely mixed and at a uniform pressure as they enter the throat member 39. It is contemplated that kinetic energy losses associated with mixing may be improved by extending the primary nozzle (not shown) so that mixing does not occur until the velocity of the secondary fluid vapor (including specifically the direction of movement) is very nearly the same as the velocity of the primary fluid exiting the primary nozzle.

The higher pressure in the subsonic diffuser chamber 41 downstream from the throat member 39 induces a normal shock of essentially zero thickness. The shock causes a compression effect and a sudden drop in the flow speed from supersonic to subsonic. Further compression of the flow is achieved as it is brought to stagnation through the subsonic diffuser chamber which discharges the medium pressure and medium temperature flow (i.e., a pressure and temperature above original stagnation properties of the secondary fluid and below the original stagnation properties of the primary fluid) to the condenser module 9. To minimize shock wave losses, the throat member 39 is preferably shaped according to a constant rate of momentum change (CRMC) method known in the art to reduce or eliminate the shock wave. The high temperature evaporator 25, primary nozzle 33 and converging and diverging throat member 39 may be broadly considered to be a "pump" in the illustrated embodiment. The primary fluid and the secondary fluid both flow through the converging and diverging throat member 39 where they lose momentum and gain static pressure so that they can condense into liquid at the condenser.

Figure 3:
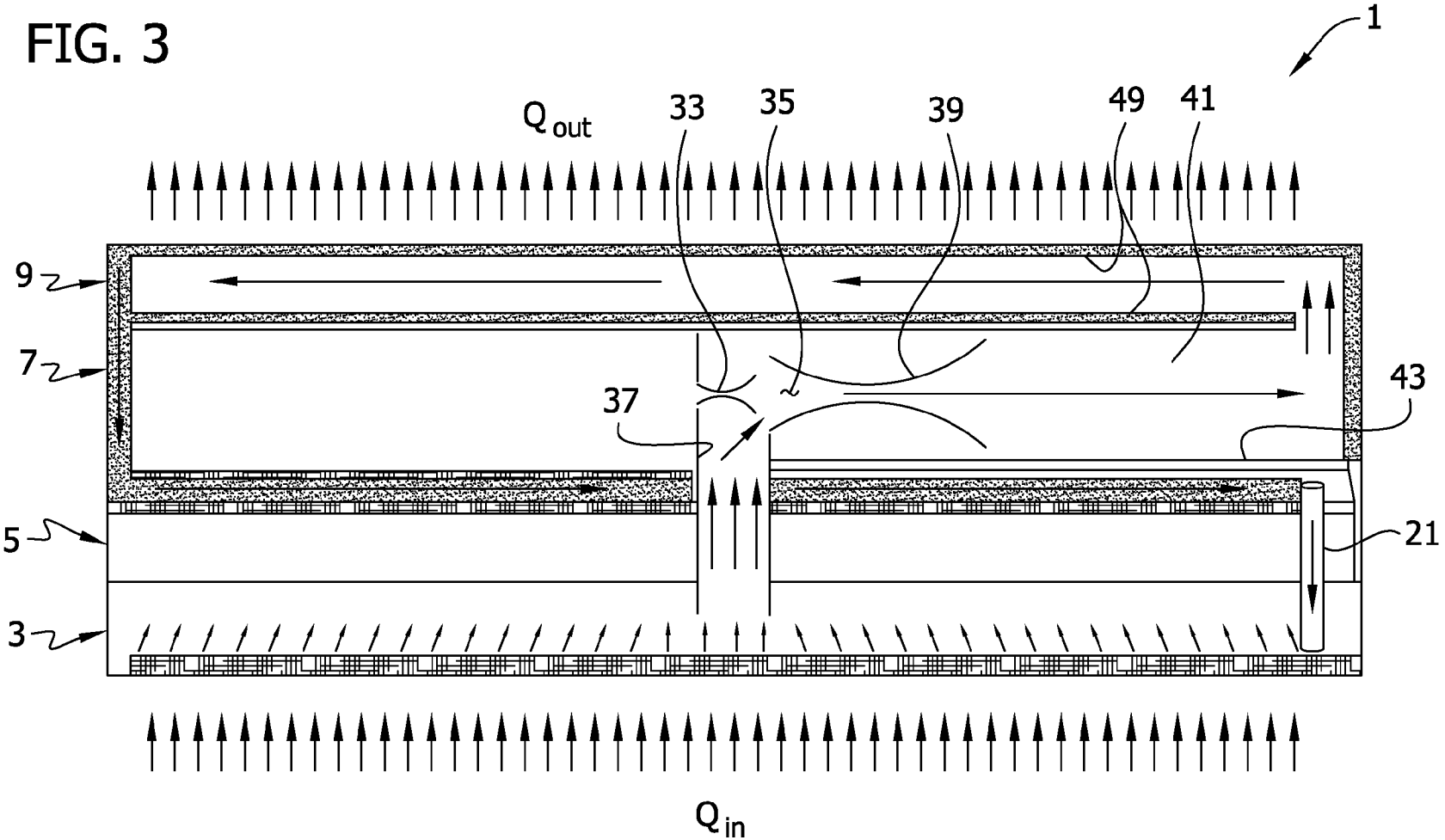
FIG. 3 is an enlarged schematic cross section of the hybrid integrated cooling system.
Figure 4:
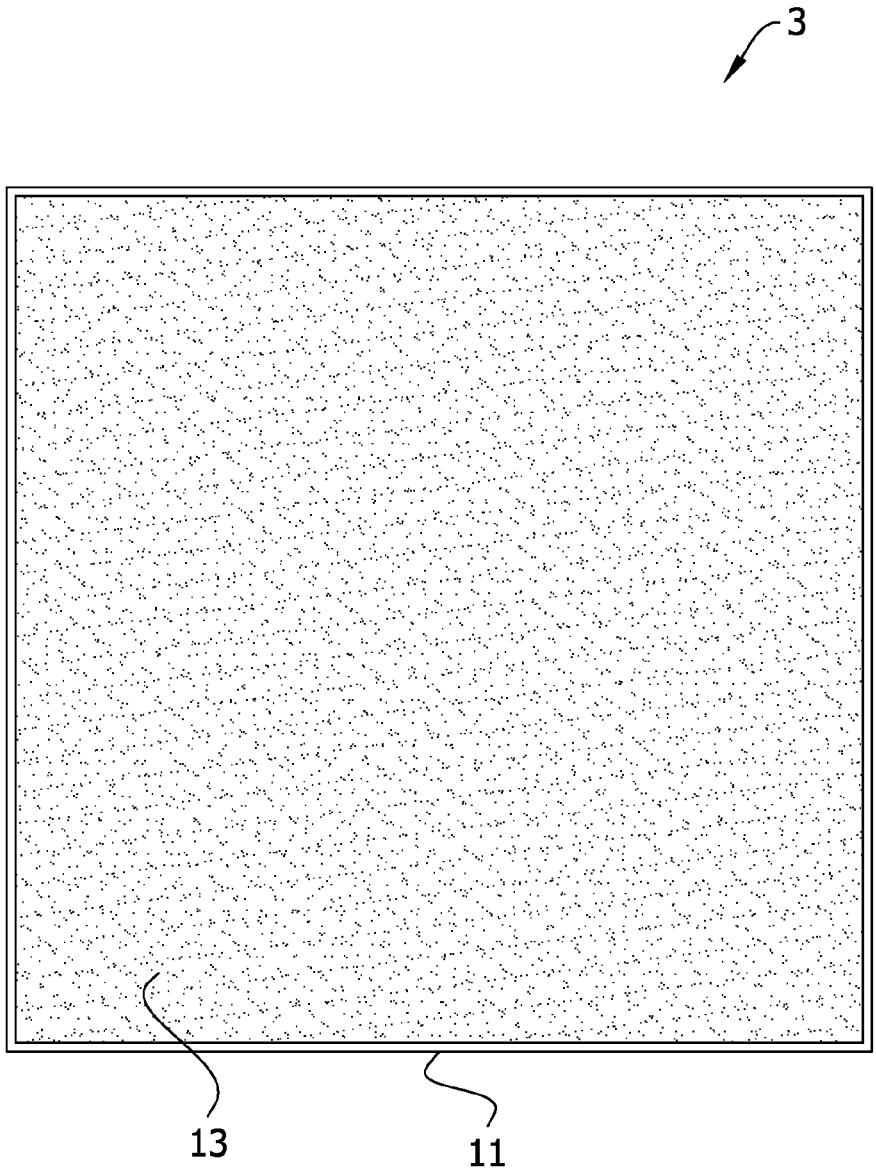
FIG. 4 is a top plan view of a low temperature evaporator of the hybrid integrated cooling system.
Figure 11:
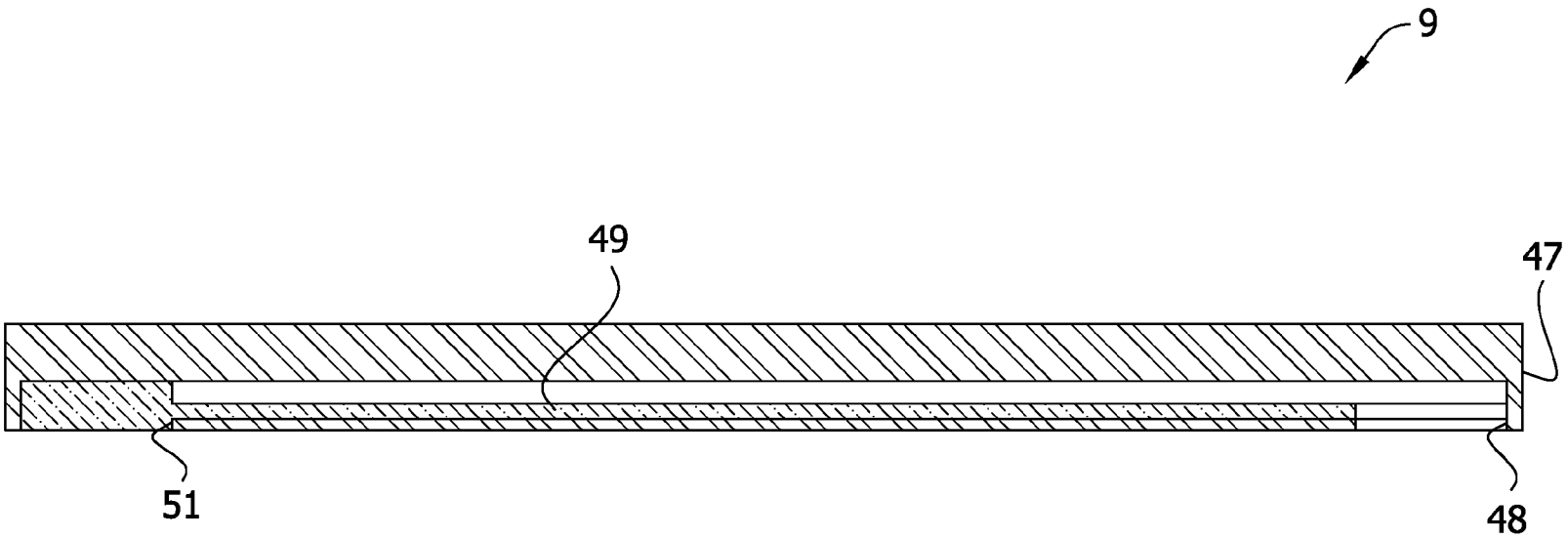
FIG. 11 is a section of the condenser module taken in the plane including line 11-11 of FIG. 10.

Referring now to FIGS. 1, 3, 10 and 11, the condenser module 9 comprises a housing 47 having a top, sides and a bottom. The top of the housing 47 is in thermal communication with a heat sink to reject heat $Q_{out}$ from the primary and secondary fluids, and therefore has low thermal resistance. The bottom of the housing 47 has an opening 48 aligned with the opening 31 of the ejector and high temperature evaporator module 7 for receiving primary and secondary fluid vapor into the condenser. The bottom of the condenser housing 47 is insulated to inhibit heat transfer through the bottom of the housing into the condenser from the high temperature evaporator 25. The primary and secondary fluids reach their saturation temperature in the condenser and liquefy. Wicking structure 49 is provided either on both the top and bottom walls, as shown in FIG. 3 or only on the bottom wall as shown in FIG. 11. An opening 51 at the left end of the condenser module 9 (as oriented in FIG. 3) provides for passage of condensed liquid out of the condenser module. Wicking structure 49 fills this opening 51 and contacts the wicking structure 29 of the high temperature evaporator 25. The wicking structure 29, 49 may be a single piece of material, but can be separate structures joined together for continuous capillary flow across the junction. The wicking structure 29, 49 is particularly constructed to produce flow of liquid into the high temperature evaporator 25, even though the pressure in the high temperature evaporator is greater than in the condenser module 9. Vapor flow through the opening 51 is blocked by the wicking structure 29, 49. The condensates flow back through wicking structures 29, 49 by capillary force to the high temperature evaporator 25 are drawn by low pressure and capillary action in wicking column 21 and wicking structure 13 into the low temperature evaporator module 3. By designing the wicking structure 13, 29, 49 and/or ducting the flow of primary and secondary fluid through the high temperature evaporator 25 back to the low temperature evaporator module 3 is controlled so that enough primary fluid remains in the high temperature evaporator for proper operation. In this way, cooling or refrigeration can be produced both by the thermoelectric cooler module 5 and by an ejector refrigeration cycle without a mechanical pump. It will be understood that low pressure in the low temperature evaporator module 3 draws condensed secondary (and primary) fluid into it. Accordingly, sufficient flow resistance in the wicking structure 13 and/or wicking column 21 is needed to avoid starving the high temperature evaporator 25 of primary fluid. The flow of fluid in the wicking structure is indicated by arrows inside the hybrid integrated cooling system 1 in FIG. 3.

It will be understood that the hybrid integrated cooling system 1 of the illustrated embodiment achieves advantages. Because the high temperature evaporator 25 for the ejector 27 is attached to the hot side of the thermoelectric cooler module 5, the heat will be directly removed by the sensible and latent heat increase of the primary fluid. This can help to reduce heat conduction from the hot side to the cold side of the thermoelectric 15. By rapidly removing heat from the thermoelectric cooler plate's hot side and preventing conduction from the hot side to the cold side, the coefficient of performance (COP) of the thermoelectric cooler module 5 can be maximized. Applications for the cooling system include without limitation, electronics cooling, microelectronics cooling, laser diode cooling, space cooling and refrigeration and other general heat transfer applications.

The waste heat rejected from the hot side of the thermoelectric cooler module plate 15 is reused to operate the refrigeration cycle of the ejector 27, thus the hybrid integrated cooling system's overall thermal efficiency is much higher than if a standalone thermoelectric cooling solution were employed. This provides for a total COP greater than the sum of the COPs of the thermoelectric cooling module 5 and ejector refrigeration system (including the low temperature evaporator module 3, the ejector 27 and the condenser module 9) individually. For example, given 1 unit input power into the thermoelectric cooling module 5, the heat received by the cold side of the thermoelectric cooling plate 15 would be $COP_{TEC}\times 1$; and the energy rejected by the hot side of the plate to drive the ejector refrigeration system would be $COP_{TEC}+1$. Thus, the cooling received by the low temperature evaporator 3 of the ejector refrigeration system is $COP_{EJ}\times(COP_{TEC}+1)$; and therefore total $COP_{TE\text{-}Ej\text{-}AC}$ is $COP_{Ej}+COP_{TEC}\ COP_{Ej}\times COP_{TEC}$. In addition, the hybrid integrated cooling system 1 will be able to operate at higher temperature differentials than standalone thermoelectric cooling devices In the refrigeration cycle of the ejector 27, liquid flow from the condenser through the high temperature evaporator 25 to the low temperature evaporator is created first by drawing the condensate to the high temperature evaporator using wick structures 29, 49 and then by sucking additional condensate to the low temperature evaporator module 3 because of its relatively low pressure when compared to the high temperature evaporator. No pump or moving parts are needed. However, the use of a pump having moving parts, valves or other components having moving parts does not depart from the scope of the present invention.

Thin film evaporation is used for both high temperature evaporator 25 and low temperature evaporator module 3 which can result in an extra high heat transfer coefficient which will improve overall system thermodynamic efficiency by minimizing the superheat between the heating surfaces and the working fluids within the system.

Having described the invention in detail, it will be apparent that modifications and variations are possible without departing from the scope of the invention defined in the appended claims.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An active cooling system for transferring heat from a heat source to an external heat sink comprising an ejector cooling system having a high temperature evaporator and a low temperature evaporator, and a thermoelectric cooling device having a hot side in thermal communication with the high temperature evaporator for supplying heat used to vaporize a primary fluid and a cold side in thermal communication with the low temperature evaporator for removing heat from the low temperature evaporator, wherein the elector comprises a nozzle and a mixing chamber, the mixing chamber being in fluid communication with the low temperature evaporator, the nozzle being in fluid communication with the high temperature evaporator and the mixing chamber; the ejector being disposed with respect to the high temperature evaporator and the mixing chamber to eject primary fluid from the high temperature evaporator and to use the nozzle to aspirate a secondary fluid vapor into the mixing chamber.

2. An active cooling system as set forth in claim 1 further comprising a condenser downstream of the ejector and in fluid communication with the mixing chamber for receiving and condensing primary and secondary fluid from the mixing chamber.

3. An active cooling system as set forth in claim 2 further comprising wicking structure in the condenser and in the high temperature evaporator constructed to move primary fluid in liquid from the condenser at lower pressure to the high temperature evaporator at a higher temperature.

4. An active cooling system as set forth in claim 3 further comprising wicking structure interconnecting the high temperature evaporator to the low temperature evaporator and constructed to resist flow of primary fluid into the low temperature evaporator so as to avoid starving the high temperature evaporator of primary fluid.

5. An active cooling system as set forth in claim 4 wherein the thermoelectric cooling device comprises a plate including the hot side and the cold side, the plate being adapted to have an electric potential.

6. An active cooling system as set forth in claim 5 wherein the plate has an opening, the fluid communication of the low temperature evaporator with the ejector occurring through the opening in the plate.

7. An active cooling system as set forth in claim 6 wherein the plate has return openings placing the high temperature evaporator in fluid communication with the low temperature evaporator.

8. An active cooling system as set forth in claim 7 wherein the low temperature evaporator includes a thin film evaporation surface to promote evaporative cooling in the low temperature evaporator.

9. An active cooling system for transferring heat from a heat source to an external heat sink comprising:

a. a low temperature evaporator adapted to receive a secondary fluid for evaporation of the secondary fluid to absorb heat from the heat source;

b. a thermoelectric cooling module which uses electrical input power to generate heat flux;

c. an ejector cooling module integrated with the thermoelectric module, the ejector cooling module including a high temperature evaporator adapted to contain a primary fluid, the thermoelectric cooling module being disposed for rejecting heat into the high temperature evaporator of the ejector cooling module, a converging-diverging nozzle connected to the high temperature evaporator for accelerating primary fluid to a high velocity and producing low static pressure, a mixing chamber for receiving high velocity primary fluid from the converging-diverging nozzle and the ejector cooling module being disposed with respect to the high temperature evaporator and the mixing chamber to eject primary fluid from the high temperature evaporator and to use the converging-diverging nozzle to aspirate secondary fluid vapor from the low temperature evaporator into the mixing chamber, a diffuser chamber for receiving mixed primary and secondary fluid vapor from the mixing chamber, the diffuser chamber being adapted to transition the flow of mixed primary and secondary fluids from high speed to stagnation so that the mixed flow can gain static pressure;

d. a condenser adapted to receive the primary and secondary fluid vapor from the ejector's diffuser chamber and reject heat to a heat sink outside the cooling system so that the vaporous primary and secondary fluids lower their temperatures to their saturation points and liquefy;

e. a wick structure connecting the condenser to the high temperature evaporator so that the liquids in the condenser can travel from the condenser to the high temperature evaporator by way of capillary force;

f. a micro/nano-structured surface within the high temperature evaporator to distribute the liquid within the high temperature evaporator and to enhance thin film evaporation heat transfer;

g. a duct between the high temperature evaporator and the low temperature evaporator constructed to pass fluid from the high temperature to the low temperature evaporator at a certain flow rate of liquid to provide sufficient flow to the low temperature evaporator but not so much flow that the high temperature evaporator lacks sufficient fluid for heat transfer from the thermoelectric cooling module or for powering the ejector;

h. a micro/nano-structured surface within the low temperature evaporator to distribute the liquid within the low temperature evaporator and to enhance thin film evaporation heat transfer;

i. insulating material located between at least one of, i. the condenser and high temperature evaporator; and ii. the ejector's diffuser and high temperature evaporator.

* * * * *